United States Patent [19]

Moreland

[11] 4,264,039

[45] Apr. 28, 1981

[54] AERATOR

[75] Inventor: Gerald W. Moreland, Garden Grove, Calif.

[73] Assignee: South Pacific Industries, Santa Ana, Calif.

[21] Appl. No.: 40,589

[22] Filed: May 21, 1979

Related U.S. Application Data

[63] Continuation of Ser. No. 862,434, Dec. 20, 1977, abandoned.

[51] Int. Cl.[3] ..... A61H 33/02

[52] U.S. Cl. ..... 239/428.5; 4/492; 4/542; 128/66; 137/888; 261/DIG. 75

[58] Field of Search ..... 4/172, 172.15, 178, 4/180, 488, 492, 496, 507, 541, 542–544, 567–569; 128/66, 370; 239/428.5; 261/DIG. 75; 137/604, 888

[56] References Cited

U.S. PATENT DOCUMENTS

| | | | |
|---|---|---|---|
| 2,555,686 | 6/1951 | Farrelly et al. | 4/180 |
| 3,628,529 | 12/1971 | Steimle | 4/180 X |
| 3,890,655 | 6/1975 | Mathis | 4/178 |
| 3,890,656 | 6/1975 | Mathis | 4/180 |
| 3,905,358 | 9/1975 | Jacuzzi | 4/180 X |
| 3,946,449 | 3/1976 | Mathis | 4/180 X |
| 3,985,303 | 10/1976 | Steimle | 239/428.5 |
| 4,119,686 | 10/1978 | Conger | 4/180 X |

FOREIGN PATENT DOCUMENTS

| | | | |
|---|---|---|---|
| 1441875 | 7/1976 | United Kingdom | 4/180 |

*Primary Examiner*—Stuart S. Levy
*Attorney, Agent, or Firm*—Gausewitz, Carr, Rothenberg & Edwards

[57] ABSTRACT

An aerator for a spa, therapy pool, bathtub or the like is formed of a mixer body having side-by-side parallel air and water conduits and a mixture outlet port extending radially of the air conduit. A water jet nozzle extends from the water conduit into the air conduit to project water across the air conduit axially into the outlet port. A group of such mixers is connected to individual ones of a number of aerator nozzles that project through the tub walls of a spa or therapy pool and the mixer air and water passages are respectively connected to one another, in series, by pipes that extend between the mixers and circumscribe the tub.

2 Claims, 9 Drawing Figures

AERATOR

This is a continuation, of application Ser. No. 862,434, filed Dec. 20, 1977, now abandoned.

BACKGROUND OF THE INVENTION

The present invention relates to liquid/gas mixers and more particularly concerns an aerator that is specifically arranged for projecting an aerated water jet into a spa, therapy pool, swimming pool, or the like.

In a common and widely used type of spa or therapy pool a recirculating water system is provided, including a return line for flowing heated water to the basin in which the spa water is confined. The desired and beneficial action of the spa is provided, or at least enhanced, by flowing air into the returning water so that a number of jets of aerated or bubble-filled water are provided at various points about the spa basin. Such an arrangement, employing a motorized blower for providing suitable source of air, is shown in a co-pending application of Lawrence E. Johnson, et al for Aerator, Ser. No. 606,299, filed Aug. 25, 1975. Such aspirators, or aerators as they are commonly termed, often employ a constricted water flow passage of the venturi type that provides a high velocity flow of water into a chamber which is supplied with air by means of an air conduit. A jet of water flows from the mixing chamber at relatively high velocity, entraining air from the chamber to thus provide an aerated water stream. U.S. Pat. Nos. 3,628,529, and 3,985,303 to W. D. Steimle, and U.S. Pat. No. 3,890,655 to Mathis, illustrate aerators of this configuration. Aerators of the type shown in the patents to Steimle and Mathis are relatively bulky and are difficult to install in restricted areas.

U.S. Pat. No. 3,890,656 to C. L. Mathis, shows a mixer in which connections for the water and air inputs are simplified. This patent employs air and water connections that may be coupled to suitable piping with relative ease in restricted areas, but nevertheless employs the widely used common mixing chamber into which both air and water are drawn from the air and water supplies for mixing and projection as an aerated jet.

Mixing arrangements of the prior art are relatively inefficient, often requiring pressurized air sources and higher water pumping power to obtain desired turbulence at the entrance of the aerated water jet into the body of water in the spa or therapy pool tub.

Where such spa or therapy pool systems are employed in commercial or public installations, such as in public spas or hotel baths, or the like, health codes require that maximum drainage of the connecting plumbing and the mixer heads themselves be provided to minimize the use of water retained from a previous use. The air/water mixing chambers of prior aerators, such as those of Steimle and Mathis, will trap residual water so that an undesired amount of water may remain in these mixers even after the bath or spa system has been otherwise fully drained. This may be unhealthy and may not meet codes.

Accordingly, it is an object of the present invention to provide a mixer that avoids or eliminates above-mentioned problems.

SUMMARY OF THE INVENTION

In carrying out principles of the present invention in accordance with a preferred embodiment thereof, a gas/liquid mixer comprises means for flowing a stream of gas and means connected with a source of liquid for projecting a jet of liquid across the stream of gas whereby the liquid jet will entrain gas from the stream to provide a jet mixture of gas and liquid. According to a specific embodiment of the invention, liquid and gas are caused to flow through liquid and gas conduits in side-by-side relation and a mixer outlet port is provided directly from and extending transversely of the gas conduit. A restricted water passage from the water conduit extends to and terminates at an orifice within the gas conduit opposite the mixture outlet port to direct a jet of liquid across the gas conduit into the outlet port.

DETAILED DESCRIPTION

Figure 1:
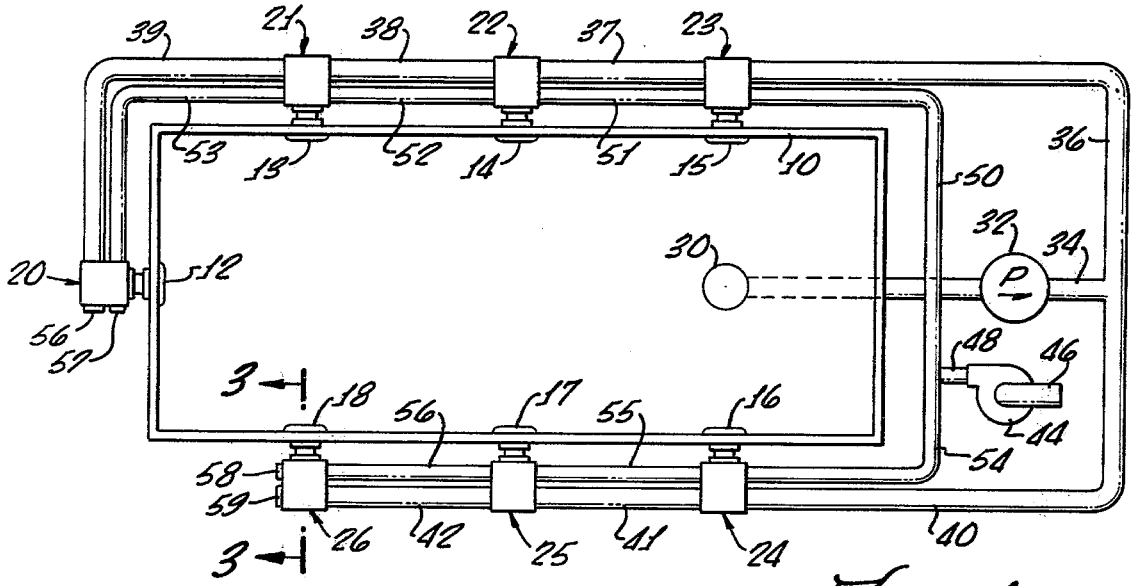
FIG. 1 illustrates a spa, therapy pool, bathtub or the like embodying a plurality of mixers constructed in accordance with principles of the present invention.

As illustrated in FIG. 1, a spa or therapy pool tub 10 is formed with a plurality of aerator jet nozzles 12, 13, 14, 15, 16, 17 and 18, each extending through the tub wall for connection with a respective one of a group of aerators or mixers generally indicated at 20, 21, 22, 23, 24, 25 and 26. The tub includes a drain 30 which is connected to a plumbing drain (not shown) and may also be alternatively connected to the input of a recirculating pump 32 having a pressure output 34 that is connected to the several mixers by means of water pipe sections 36, 37, 38, 39, 40, 41 and 42. An air blower 44, has an input 46 that is connected with atmosphere and has an output line 48 connected to the several mixers by means of air pipe sections 50, 51, 52, 53, 54, 55 and 56.

Water is forced by the pump through the several water pipes, through the mixers 21, 22, 23, 24 and 25, which are all connected in series with each other, and to the terminal mixers 20 and 26. The water flows through all of the mixers and thence through passages to be described below and through the aerator nozzles 12–18.

Air is forced by the blower through the air pipes and through the mixers 21, 22, 23, 24 and 25, in series, and thence to the terminal mixers 20 and 26. At each of the mixers air is entrained by the water jet that is expelled through the aerator nozzle from the mixer body to provide the desired aerated jet projected into water within the tub. Although a blower 44 has been shown, it is found that aeration action of the mixer described herein is of such enhanced efficiency that the air pipes may simply be connected at any given point or points to the atmoshpere without the use of any blower. A sufficient air flow is provided by the entrainment of air within the mixers by the jet action of the water.

Of course, suitable timers, heaters, and the like (not shown) may be used, as commonly provided, to complete the illustrative system.

Figure 2:
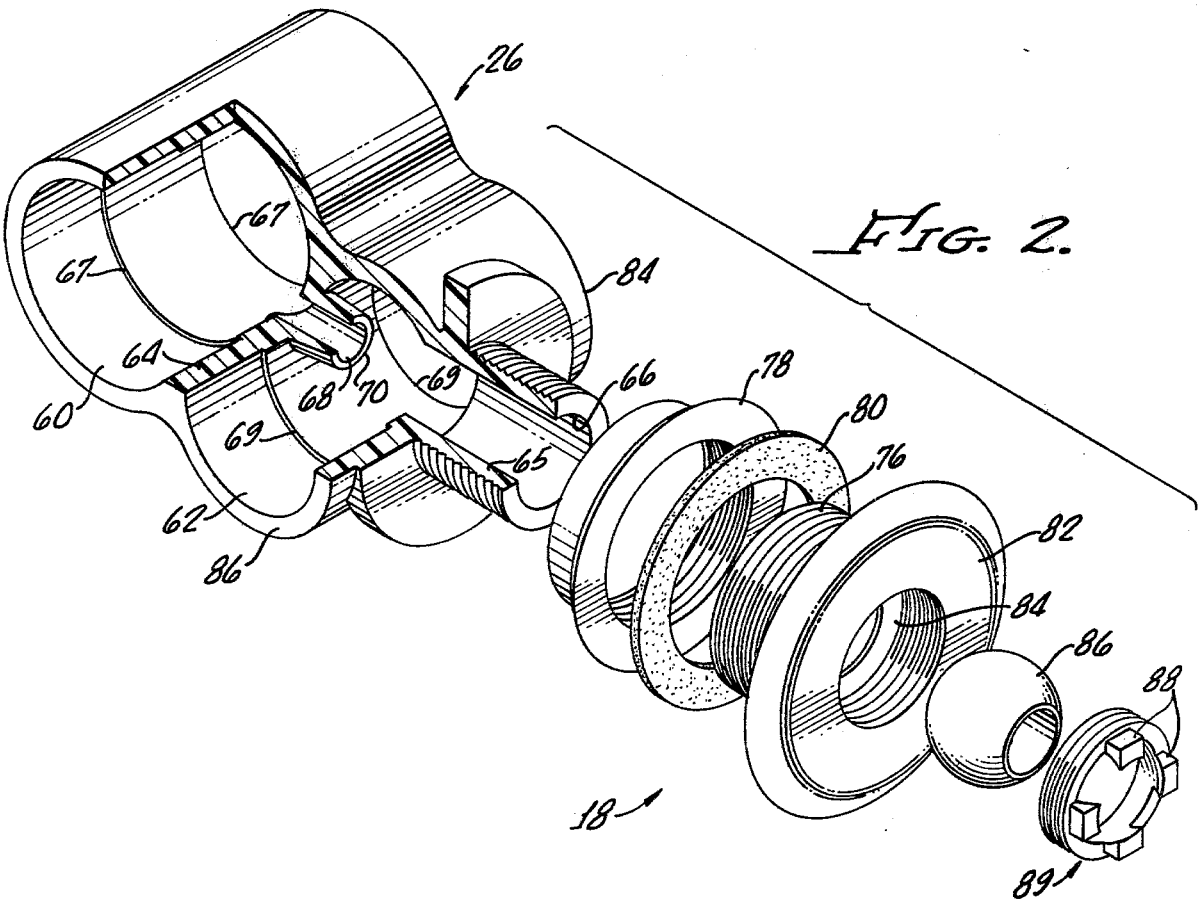
FIG. 2 is an exploded pictorial illustration, with parts broken away, of a single mixer and nozzle of the system of FIG. 1.
Figure 3:
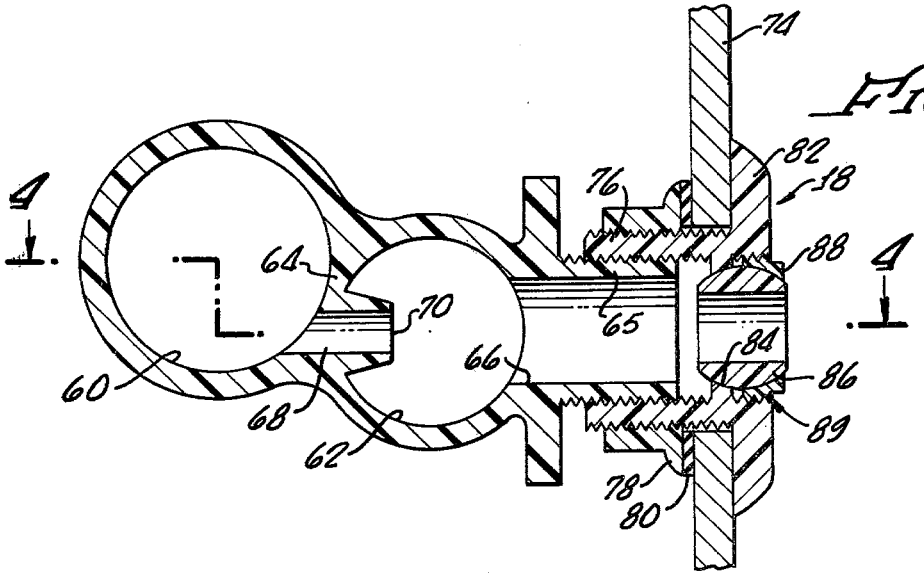
FIG. 3 is a section taken on lines 3—3 of FIG. 1, with end plugs omitted.
Figure 4:
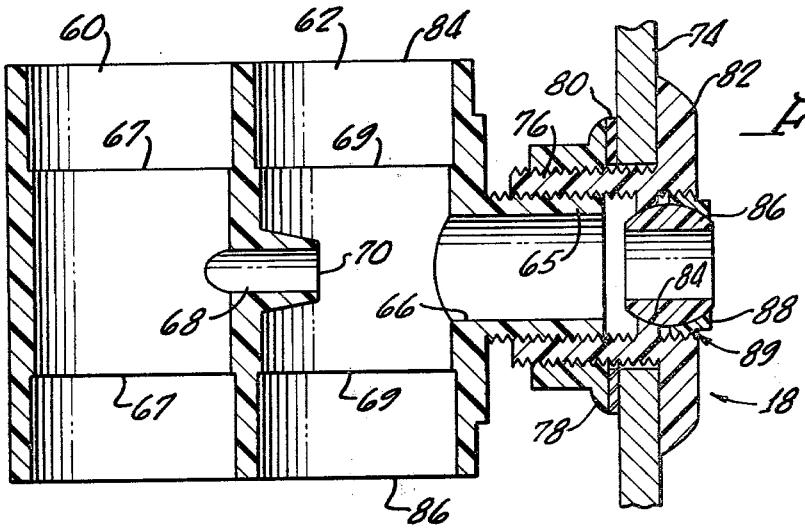
FIG. 4 is a section taken on lines 4—4 of FIG. 3.

As shown in FIGS. 2, 3 and 4, each mixer is identical to mixer 26 and comprises a mixer body having formed therein short sections of conduit 60 and 62. Conduit section 60, for all but the terminal mixers, is connected at each of its open ends to one of the sections of water pipe. Similarly the air conduit 62 is connected at each of its open ends to sections of air pipe. For the terminal mixers 20 and 26, the downstream ends of the conduits are sealed by plugs 56, 57, 58 and 59.

The water and air conduits 60 and 62 are parallel to each other and closely juxtaposed with a relatively thin wall 64 formed therebetween. Air conduit 62 is formed with a transversely extending nipple 65 that defines a mixture outlet port or passage 66 extending substantially radially from the air conduit to project an air/water mixture transversely from the mixer conduits. The internal diameter of the outlet port 66 may be substantially equal to or slightly less than the internal diameter of the air conduit 62. At each end of each of conduits 60, 62 is formed a shoulder 67, 69 to seat a connecting pipe or plug that is adhesively secured and sealed to the conduit end. The connecting pipes or plugs are readily inserted longitudinally into the water or air conduits and adhesively secured and sealed without fittings. Plugs and pipes are omitted from FIGS. 2–9 for the sake of clarity of the drawings.

A small diameter water passage 68 extends from the interior of the water conduit 60 into the air conduit 62 where it terminates in a restricted, relatively small orifice, 70 that provides a high velocity water jet. Orifice 70 is positioned relatively close to the common wall 64 between the air and water conduits so that the water passage 68 does not extend very far into the air conduit. Passage 68 and its orifice 70 are directed substantially radially of the air conduit so that the water jet that is projected from the water conduit into the air conduit is projected transversely of the latter and will flow almost completely across the interior of the air conduit to the mixture outlet 66. Orifice 70 of the water passage 68 is positioned diametrically opposite the mixer outlet passage of the air conduit so that the jet from the water conduit is projected substantially coaxially of and through the mixture output passage.

To secure the mixer body to the wall 74 of the tub (see FIGS. 3 and 4) and to the aerator nozzle 18, the exterior of nipple 65 is externally threaded to cooperate with internal threads on a stem 76 of the nozzle 18. The stem 76 is also externally threaded to threadedly receive an internally threaded retaining nut 78 that firmly presses against a gasket 80 interposed between the nut and the tub wall to thereby fixedly secure the nozzle 18 with its flange 82 to the wall 74. If deemed necessary or desirable, additional washers or gaskets may be employed and various types of sealing compound or sealing tape may be placed between the interengaging threads to further enhance the sealing of the several elements to each other.

As illustrated in FIG. 2, the stem of nozzle 18 is formed with an internal conical seat 84 upon which rests a truncated apertured spherical eyeball 86 that is held in place by a plurality of circumferentially spaced projections 88 on a nut 89 that is threadedly engaged within the nozzle stem 76.

The described aerators may be made of any suitable metal, such as copper, steel, aluminum or alloys thereof, or of plastic. Presently preferred configurations are injection molded, the entire mixer body, including the water jet 68, 70 and conduits 60, 62 being a single integral part. Many different types of plastic may be employed. For example, the housing may be made of PVC (polyvinylchloride) and other parts such as the wall fitting, including the nozzle 18, eyeball and nut 78, 89 (but excluding the gasket of course) may be made of ABS (acrylonitrile-butadiene-styrene copolymer).

As can be seen in the illustrations of FIGS. 3 and 4, the water passage 68, where it projects slightly into the air conduit 62, has a conical exterior configuration to provide for a smooth flow of air from one end to the other of air conduit 62. Thus a continuous stream of air flows through the air conduit 62 contacting the nozzle of water passage 68 about its entire periphery. Accordingly, the water jet issuing from the restricted orifice 70 is completely surrounded, for a full 320°, by the flowing air stream across which it is projected. This maximizes entrainment of air into the water jet stream and thus maximizes aeration of the exiting mixture, which is caused to flow through the outlet port 66.

Although the bore of water passage 68 between conduits 60 and 62 is illustrated as being of a right circular cylindrical configuration, it will be readily appreciated that an improved venturi-type action may be provided by use of conventional converging, or converging and diverging nozzle configurations to further increase the velocity of the water as it enters the air conduit 62 and to otherwise improve the water jet characteristics.

Where the described mixer is used as a terminal mixer, that is, the last one in series, such as shown for mixers 20 and 26 of FIG. 1, one end of the water conduit and one end of the air conduit is simply plugged, as previously described, so that neither water nor air will flow from such mixer except through the air conduit mixture outlet port. Otherwise all mixers of an installation are identical.

The described arrangement provides a surprising and unexpected increase in the aeration of the projected water.

Contrary to expectations, it has been found that the projection of the water jet from orifice 70 directly into the air stream that flows through air conduit 62 not only achieves an efficient aeration of the water jet as it substantially completely traverses the air conduit, but also provides a surprising and unexpected increase in the actual aeration. Even without the use of a blower, merely using the jet action of the water to pull the air through the various air pipes and through the mixer air conduits, the air/water mixture exiting from the aerator nozzles 12–18 evidence a considerably increased bubble action and water turbulence as compared to action and turbulence available with conventional mixers of the type shown in the Steimle or Mathis patents.

For example, it is found that a one-half horsepower water pump will provide as much "action" or turbulence at the output of six mixers of the type described herein as is provided by a three-quarter horsepower pump at the outputs of six mixers of prior art configuration.

In normal use of the described mixers, they are installed with axes of the water and air conduits substantially horizontal, but tilted slightly to facilitate drainage (upon completion of a bath) of the entire series of mixers. Thus the mixers in series are positioned at successively lower elevations, and one is lower than all other mixers and lower than all or nearly all of the system pipes, in a preferred installation.

The axes of the mixture outlet passages also are nearly horizontal, but this is determined at least in part by the orientation of the tub wall. In any event, for any one mixer, the lower part of air conduit 62 is the lowest point of the mixer interior. Both the outlet passage and the water conduit are above the air conduit. Thus, little or no water will be trapped within the outlet passage or water conduit. Substantially all water will drain into the tub or back into the mixer air conduit and thence through the connecting pipes to the lowest mixer. If deemed necessary or desirable, a suitable drain orifice (not shown) may be connected at a low point in the air pipe and conduit system.

Residual water in the water conduits will drain through connecting pipes to a drain connection at a low point in the pipes and will also drain, within each mixer, to the mixer air conduits and connecting pipes thereof. If a water draining orifice is not provided in the air pipes, adequate drainage (better and more complete drainage than available with prior art mixers) will take place (into the tub) through the outlet passage of the lowermost of all of the mixers of the series, leaving only a very small (and acceptable) amount of undrained water within the air conduit of the body of the lowest mixer.

Although the described orientation is preferred, the mixers may be inverted and installed with the water conduit lowermost so that the outlet passage is above the air conduit and the latter is above the water conduit. Again drainage will take place through both water and air conduits and through both water and air connecting pipes, leaving only a small amount of residual water in the body of the lowest mixer. Thus water used by one person is nearly all drained and only a few ounces, at most, remain in the system to be used by a second person.

Figure 5:
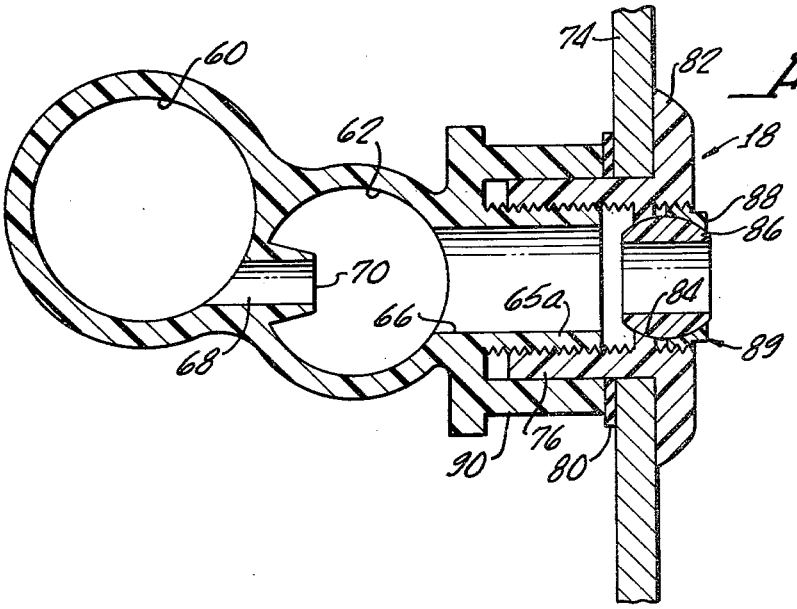
FIG. 5 is a sectional view of a modified mounting of the mixer to a tub wall.

In an alternate mounting of the described mixer, as illustrated in FIG. 5, a sleeve 90 is fixed to (or molded integral with) the body of the mixer to provide proper spacing of the mixer from the tub. The end of the sleeve bears upon the gasket 80, interposed between the sleeve end and the tub wall, and the outlet nipple 65*a* of the mixer is threadedly received within the stem 76 of the aerator nozzle 18 to firmly draw the mixer and its sleeve 90 against the tub to lock the nozzle and the mixer to the tub wall. All other parts of the arrangement of FIG. 5 are the same as in the embodiment of FIGS. 2–4 and are designated by like reference numerals.

Figure 6:
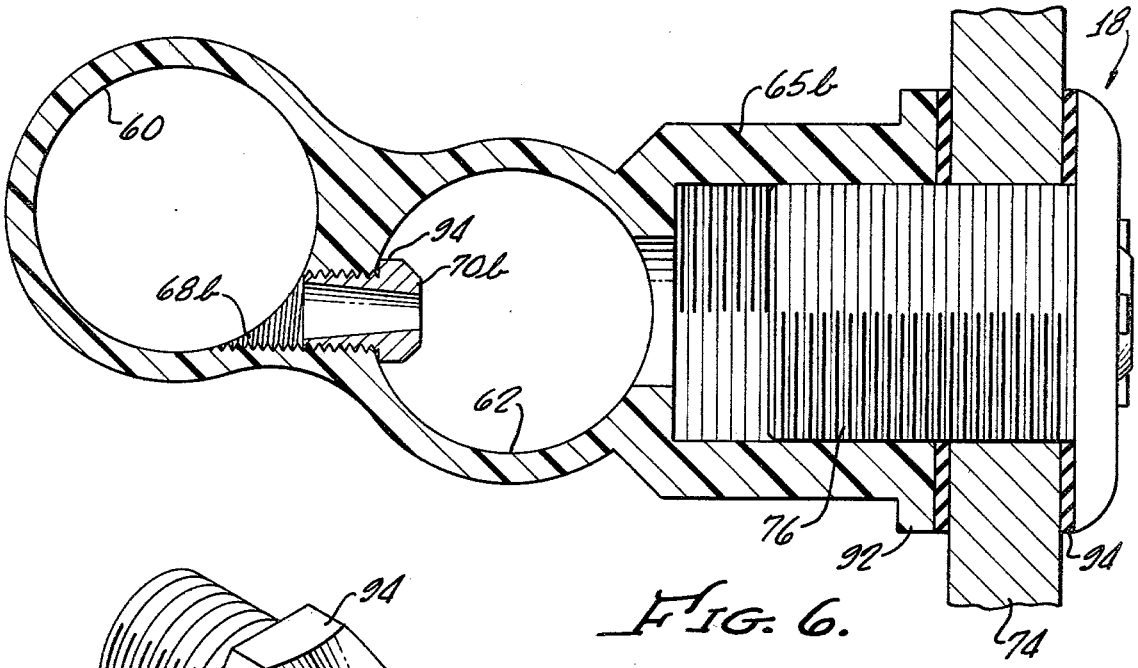
FIG. 6 illustrates a modification showing a different type of wall mounting and a readily removable jet nozzle.

In an alternate tub wall mounting arrangement, as shown in FIG. 6, the mixture outlet nipple 65*b* is provided with an outwardly radially extending circumferential flange 92 that bears against the gasket 80, which, in turn, bears against the tub wall 74. Nipple 65*b* in this arrangement is internally threaded to receive the external threads of the stem 76 of the nozzle 18 and a second gasket 94 is interposed between the nozzle and the inside of the tub wall.

Water jet nozzle 70*b* of the embodiment of FIG. 6 is a separate part, externally threaded, and threadedly engaged with internal threads formed in the passage 68*b* that interconnects the water and air conduits 60, 62. The forward end of the nozzle 70*b* that projects into the air conduit is formed with a plurality of flat tool-receiving surfaces such as that indicated at 94, so that a tool can be inserted through the mixture outlet passage of the mixer (after removal of the aerator nozzle 18) and the jet nozzle 70*b* may be replaced as deemed necessary or desirable. Each of a number of nozzles 70*b* may be made with different interior passage dimensions to obtain a balanced pressure (equally or otherwise distributed) about the periphery of a tub in which a plurality of mixers are used. Thus those mixers that are closer to the pump, such as mixers 23 and 24 of FIG. 1, may be provided with nozzle 70*b* having a relatively smaller interior water passage and those furthest from the pump, such as mixers 20, 21 and 26, may be provided with nozzles 70*b* having larger diameter interior water passages, whereby the normal pressure drop of the water flowing from the pump to the final mixers is compensated by the nozzle orifice size which progressively increases as the mixer is positioned further from the pump.

Although it is presently preferred to provide a compact mixer head wherein the air and water conduits are closely juxtaposed with a relatively thin common wall therebetween, many other arrangements and configurations of the two conduits of the mixer head may be employed without departing from principles of the present invention. It is not necessary, for practice of the described invention, that the water and air flow through the two side-by-side conduits in the same direction, or even in parallel directions.

Figure 7:
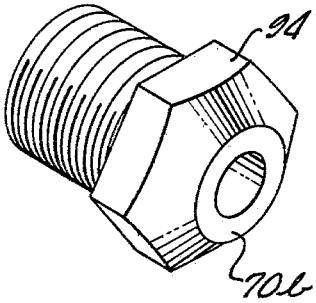
FIG. 7 is a pictorial illustration of the removable jet nozzle of FIG. 6 showing the hexagonal tool receiving configuration.
Figure 8:
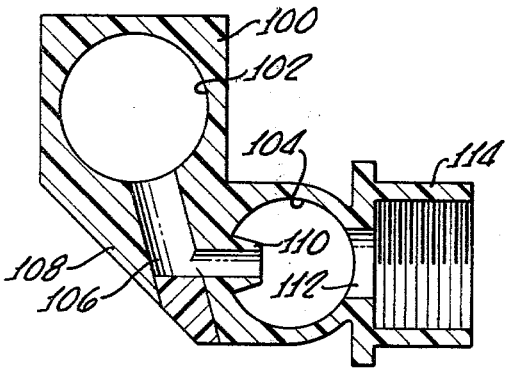
FIGS. 8 and 9 illustrate other configurations of side-by-side water and air conduits.

Illustrated in FIG. 8 is a modification of the mixer of FIGS. 2–7 in which the water and air conduits have a different location with respect to one another. The two may be further spaced from each other if deemed necessary or desirable, although closer spacing minimizes material and size. Thus the mixer body 100 of FIG. 8 is somewhat angulated, having an upper portion through which is formed a water conduit 102, and having a lower laterally projecting portion through which is formed an air conduit 104. A water passage 106 extends through an intermediate section 108 of the mixer body, and, as shown in FIG. 8, has a relatively large diameter at the water conduit 102 and a relatively small diameter at the water jet nozzle orifice 110 that terminates at a position just inside the air conduit 104.

The water jet nozzle 110 and the immediately adjoining portion of water passage 106 are directed radially of the air conduit 104 just as in the previous embodiments and are diametrically opposed to the mixture outlet port 112 that also extends transversely of or, more specifically, radially of the air conduit. A sleeve 114 fixed to the mixer body may be threaded internally or externally as desired for suitable securement to the tub wall and to the aerator nozzle in the manner previously described.

Figure 9:
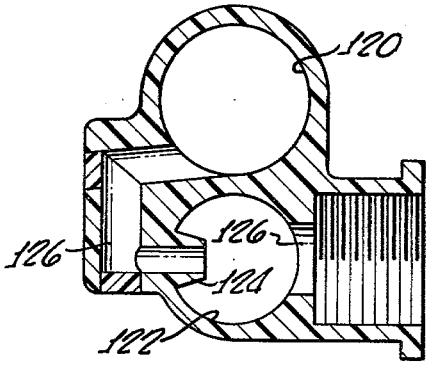

FIG. 9 illustrates still another arrangement of side-by-side water and air conduits. This arrangement, like the arrangement of FIG. 8, provides mixer action of enhanced efficiency with a decreased dimension of the mixer body in a direction along the axis of the mixer outlet passage. Thus this mixer, like the mixers previously described, may be retrofitted to an existing bathtub in a relatively small and narrow space between such bathtub and the wall of the room in which it is installed. In the arrangement of FIG. 9, the water conduit 120 is positioned directly above air conduit 122 and water is transmitted from the conduit 120 to jet nozzle 124 in the air conduit by means of a water passage 126 that interconnects the water and air conduits. In this arrangement, as in all of the other embodiments of the mixer, water transmitted through the jet nozzle 124 is projected substantially along a diameter of the air conduit in a stream that is coaxial with the mixture outlet passage 126 to provide the improved air entrainment previously described.

It is presently preferred to manufacture the mixer body (including the water jet nozzle, where the latter is not removable) as an integral part injection molded of a suitable plastic of a type commonly used for similar fittings and spa components, such as the PVC described above. Nevertheless, it will be readily appreciated that the mixer may be manufactured of other materials and in two or more individual parts suitably secured together in one of the described configurations or an equivalent configuration wherein a jet of liquid is projected across and through an air stream flowing through an air conduit.

The water jet nozzles of any one of the embodiments may be removable, like nozzle **70*b* of FIGS. 6 and 7**.

The foregoing detailed description is to be clearly understood as given by way of illustration and example only, the spirit and scope of this invention being limited solely by the appended claims.

What is claimed is:

1. A mixer for a spa, therapy pool or the like having a plurality of spaced air/water mixers connected to aerator nozzles, said mixer comprising an integral molded mixer body having side by side mutually parallel air and water conduits extending therethrough and having a common wall therebetween, said conduits being open at both ends for flowing mutually parallel main streams of air and water through said mixer body from one end thereof to the other, a mixture outlet passage opening directly into a side of said air conduit opposite said water conduit between the ends of said air conduit and extending transversely thereof to the exterior of said body, and jet nozzle means aligned with said outlet passage along a diameter of said air passage, said nozzle means comprising a water passage extending through said common wall, said water passage having an inlet in said water conduit and having an outlet in said open ended air conduit close to said common wall and opposite said mixture outlet passage for projecting water directly into one side of said main stream of air as the air flows through the air conduit parallel to the flow of water in the water conduit and for projecting water almost completely across a diameter of said air conduit and almost completely across a diameter of said main stream of air into said outlet passage to pull air into said outlet passage as the main air stream flows from end to end of said open ended air conduit across said water passage outlet.

2. The mixer of claim 1 wherein said water conduit is positioned above said air conduit, wherein said water passage extends straight through a lower part of said common wall of said water conduit, and wherein air is mixed with the water within the air conduit as the main air stream flows through the air conduit.

* * * * *